US006354307B1

(12) United States Patent
Potut

(10) Patent No.: US 6,354,307 B1
(45) Date of Patent: Mar. 12, 2002

(54) CONCEALED SPRING HINGE FOR HAIRSTYLING DEVICES

(75) Inventor: Christian Potut, Arbent (FR)

(73) Assignee: C.S.P. Diffusion, Arbent (FR)

( * ) Notice: Subject to any disclaimer, the term of this patent is extended or adjusted under 35 U.S.C. 154(b) by 0 days.

(21) Appl. No.: 09/723,782

(22) Filed: Nov. 28, 2000

(30) Foreign Application Priority Data

Nov. 29, 1999 (FR) ..... 99 15224

(51) Int. Cl.[7] ..... A45D 8/20
(52) U.S. Cl. ..... 132/277
(58) Field of Search ..... 132/277, 276, 132/275; 24/509, 510

(56) References Cited

U.S. PATENT DOCUMENTS 2,201,719 A 5/1940 Eicher
5,666,702 A * 9/1997 Ming-Chieh ..... 24/510
5,842,482 A * 12/1998 Potut ..... 132/277

FOREIGN PATENT DOCUMENTS

| | | |
|---|---|---|
| EP | 0 847 710 A1 | 6/1998 |
| EP | 0 901 759 A1 | 3/1999 |
| FR | 755662 | 5/1933 |
| FR | 770805 | 3/1934 |

* cited by examiner

*Primary Examiner*—Todd E. Manahan
(74) *Attorney, Agent, or Firm*—Ratner & Prestia

(57) ABSTRACT

A hairstyling device includes two jaws hinged together about a transverse hinge axis around which a helical spring is helically wound. The spring is contained in an opaque casing attached to the first jaw and which has an end notch through which one second radially projecting end of the spring passes to bear against the second jaw. The casing is in one piece, with a rim at one end covering the outside edge of a first perforated lug to prevent rotation. Its other end has no rim but is associated with another first perforated lug which is oversized and has an outside edge substantially continuous with the outside lateral surface of the casing.

7 Claims, 6 Drawing Sheets

CONCEALED SPRING HINGE FOR HAIRSTYLING DEVICES

BACKGROUND OF THE INVENTION

1. Field of the Invention

The present invention relates to hairstyling devices in which a first jaw is hinged to a second jaw by hinge means including a return spring.

2. Description of the Prior Art

Hairstyling devices in the form of clips for use in women's hair are known in the art. Clips of this kind have been used for many years, and are described especially in documents FR-A-770 805, FR-A-755 662 or U.S. Pat. No. 2,201,719.

Prior art hairclips generally have a first jaw and a second jaw, hinged together by hinge means allowing them to pivot about a hinge axis between a spread apart position and a close together position. Spring means bias pivoting relative movement of the first and second jaws toward their close together position. The hinge means comprise two first parallel perforated lugs on the first jaw spaced apart for stability, and, two parallel perforated lugs on the second jaw appropriately spaced apart to engage with respective opposite sides of the first perforated lugs. A connecting spindle, oriented along the hinge axis, passes through the four perforated lugs to connect the jaws.

In these prior art hairclips, the spring means comprise an elastically flexible metal wire spring wound helically around the hinge axis. A first end of the elastically flexible wire extends radially away from the axis and bears on the inside face of the first jaw. The second end of the elastically flexible wire extends radially away from the axis and bears against the second jaw. The spring is prestressed rotationally about the axis, so that its two projecting ends bias the jaws toward their close together position.

A first disadvantage of the above prior art structure is the result of the particular use of the hairstyling devices, whereby their rear part, which is the part consisting of the hinge area and the elastically flexible metal wire wound in a helix, can be seen when they are placed in the hair. This produces a particularly unesthetic effect, because the structure of the elastically flexible metal wire spring is clearly visible and gives the appearance of a mechanical device to a hairstyling device that in theory should constitute an ornamental item.

Another important disadvantage of the above prior art structure is the difficulty of fitting the prestressed spring. The four components, namely the two jaws, the spring and the connecting spindle, have to be assembled at one and the same time, while applying an appropriate force to the spring to overcome the prestressing force exerted by its radially projecting ends.

The document EP-A-0 901 759 proposes to conceal the helical spring behind a wall attached to one of the jaws. This solution does not solve the problem of the difficulty of fitting the prestressed spring, and in fact tends to accentuate this difficulty by restricting access to the area occupied by the spring.

The document EP-A-0 847 710 proposes to incorporate the helical return spring in a casing attached between the first perforated lugs. The casing is obtained by assembling a main casing body with a U-shaped cross section, and an end hoop attached to the casing body to extend its second end, leaving an arcuate external peripheral slot for one projecting end of the spring to pass through. The two ends of the resulting casing overlap on the outside edge of the first lugs of the hinge. The hinge lugs of the jaws are therefore, in this embodiment, all the same size, and the first lugs are capped by the casing, which constitutes a tube into which the helical return spring is inserted. The casing therefore provides visual continuity between the first two lugs, concealing the spring to confer on the product an esthetic appearance that is pleasing to the eye.

A first disadvantage is the relatively high cost of manufacturing the two-part casing; another disadvantage is that it is relatively complicated to assemble onto the jaws of the hairstyling device. The casing must be molded from a plastics material, and mass production implies the molding of a series of bodies and hoops on opposite sides of a main sprue to which the bodies and the hoops are joined by secondary sprue. It is possible to separate the bodies from the main sprue by breaking the secondary sprues. However, this is not possible for the end hoops, because they are too small, thinner than the diameter of the main sprue. As a result, after injection molding, the hoops and the bodies remain attached to the main sprue. An additional operation of removing them from the sprue by cutting through the bases of the secondary sprues is therefore required.

Also, a complex mold is required to form the lugs and the holes for assembling the hoop onto the main casing body. Given the very small dimensions of the components of the assembly, there are high risks of the parts of the mold that produce them breaking, and the mold parts must have specific and complex movements.

The components are therefore costly to manufacture. However, they are also complex and costly to assemble: the spring must be inserted into the main casing body, then the hoop fitted to the end of the casing body, and finally the spring tensioned and the casing placed on the first jaw of the hairstyling device. The operation is difficult to automate, and calls for a careful and experienced assembly workforce.

The problems addressed by the present invention are those of concealing the helical return spring of the jaws of a hairstyling device, facilitating mounting the spring on the hairstyling device, reducing the cost of manufacturing the component parts of the hairstyling device, and reducing the cost of assembling the hairstyling device.

The basic idea of the invention is to accommodate the return spring in a casing, which facilitates subsequent assembly of the spring onto the jaws of the hairstyling device, and to use a one-piece casing, with no end hoop, which reduces the difficulty of assembling and the cost of manufacturing the components.

To achieve the above and other objects, a shorter casing is used, only one end of which covers the outside edge of one of the first lugs of the first jaw, while the other end of the casing merely bears against the other first lug of the first jaw without covering it and the other first lug of the first jaw is oversized so that it is continuous with the peripheral face of the casing, which achieves visual continuity and conceals the spring.

SUMMARY OF THE INVENTION

Accordingly, in a hairstyling device according to the invention :

- a first jaw and a second jaw are hinged together by hinge means enabling them to pivot about a transverse hinge axis between a spread apart position and a close together position,
- an elastically flexible wire spring is wound helically around the transverse hinge axis and has two radially projecting ends respectively adapted to bias the first jaw and the second jaw relative to each other toward the spread apart or the close together position, the hinge means include two parallel first perforated lugs on the first jaw spaced apart by a distance for stability, and two parallel second perforated lugs on the second jaw spaced apart by a distance appropriate for them to engage with respective opposite sides of the first perforated lugs, and a connecting spindle oriented along the transverse hinge axis and passing through the four perforated lugs to connect the jaws, a casing is attached between the first perforated lugs, retained in a fixed position on the first jaw and forming an axial internal housing containing at least the helically wound portion of the spring, the first radially projecting end of the spring being in fixed bearing engagement with the casing or with the first jaw, the second radially projecting end of the spring exiting the casing to bear functionally against the second jaw and to bias it toward the close together position, the casing having ends with axial openings through which the connecting spindle can pass, the casing has a peripheral lateral wall with a generally cylindrical outside surface and its first end is extended by a rim on three of its sides to enclose at least in part the outside edge of the corresponding first perforated lug, the second end of the casing has no rim, and includes an end notch through which the second radially projecting end of the spring passes and in which it can move, the other first perforated lug of the first jaw is oversized so that its outside edge is substantially continuous with the outside surface of the lateral wall of the casing.

The casing is preferably made in one piece.

In one advantageous embodiment, the second perforated lugs carried by the second jaw are oversized so that their respective outside edges are substantially continuous with the outside surface of the lateral wall of the casing.

The outside surface of the lateral wall of the casing preferably takes the form of a sector of a circular cylinder. This achieves improved visual continuity with the perforated lugs in all relative angular positions of the jaws.

Other objects, features and advantages of the present invention will emerge from the following description of particular embodiments of the invention, which description is given with reference to the accompanying drawings.

DETAILED DESCRIPTION OF THE PREFERRED EMBODIMENTS

Figure 1:
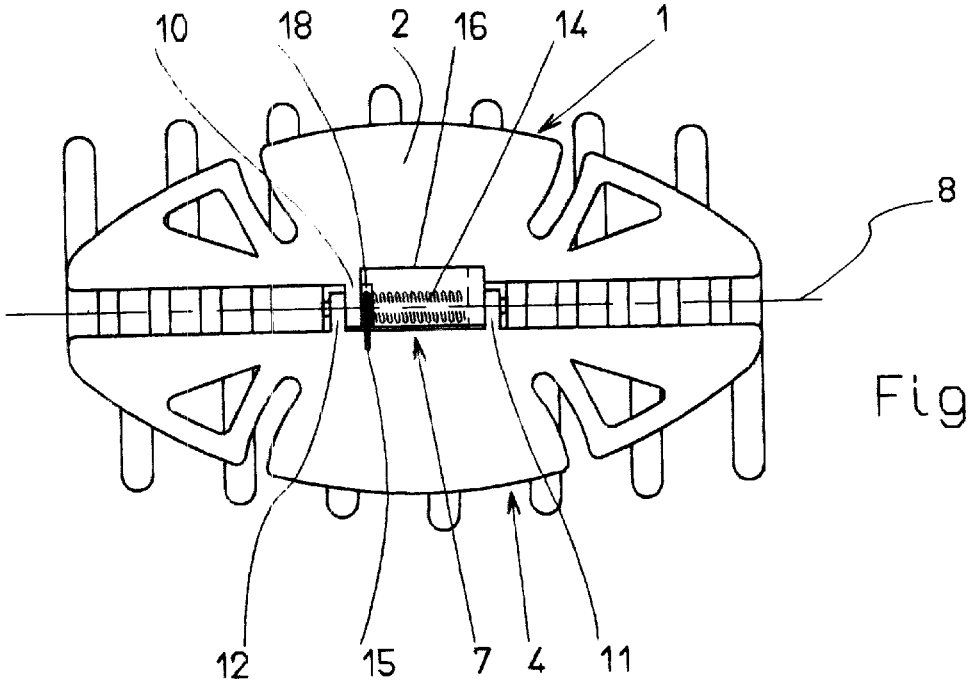
FIG. 1 is a front view of a hairstyling device in the form of a hairclip constituting one embodiment of the present invention, shown in a closed position.

In the embodiments shown in the figures, a hairstyling device in accordance with the invention is a hairclip having a first jaw 1 which can be actuated by a first opening lever 2 to which it is fastened in a first intermediate connecting area 3, and a second jaw 4 which can be actuated by a second opening lever 5 to which it is fastened in a second intermediate connecting area 6.

Figure 2:
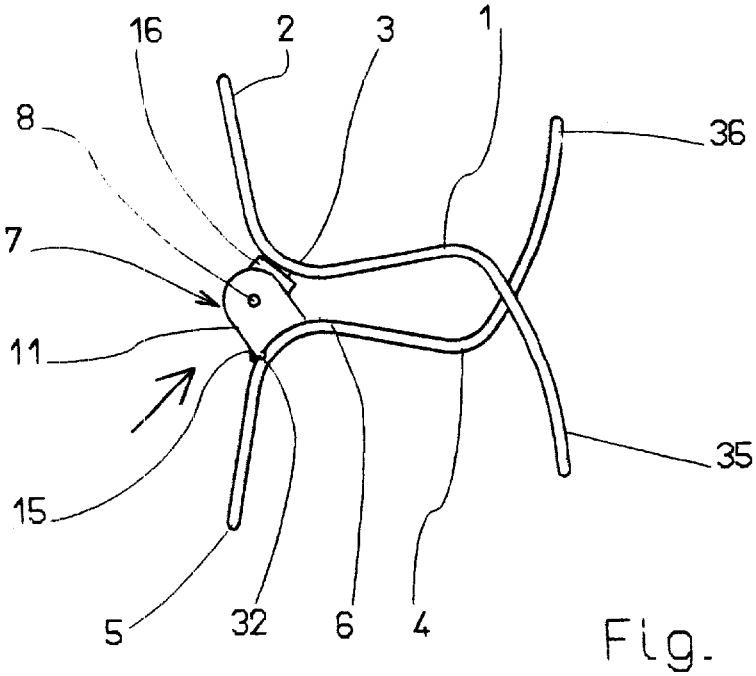
FIG. 2 is a right-hand side view of the hairstyling device from FIG. 1, shown in the closed position.
Figure 3:
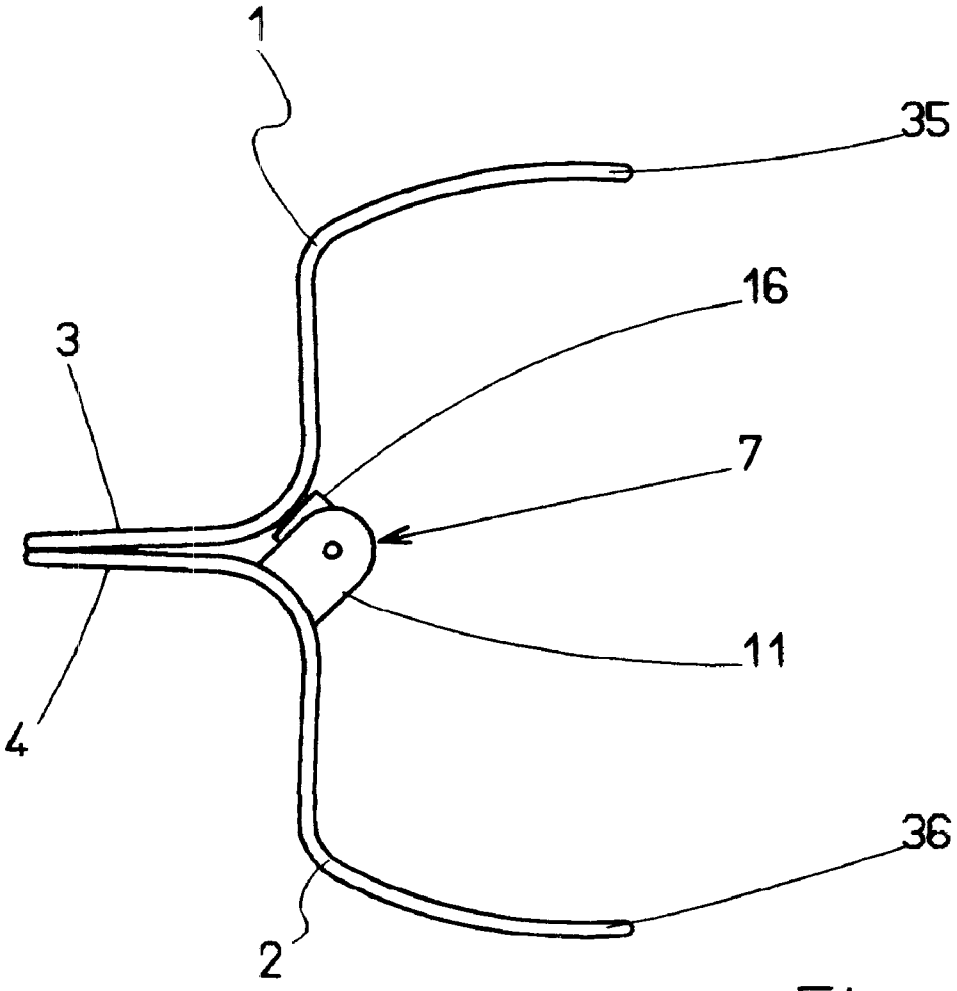
FIG. 3 is a right-hand side view of the hairstyling device from FIG. 1, shown in an open position.
Figure 4:
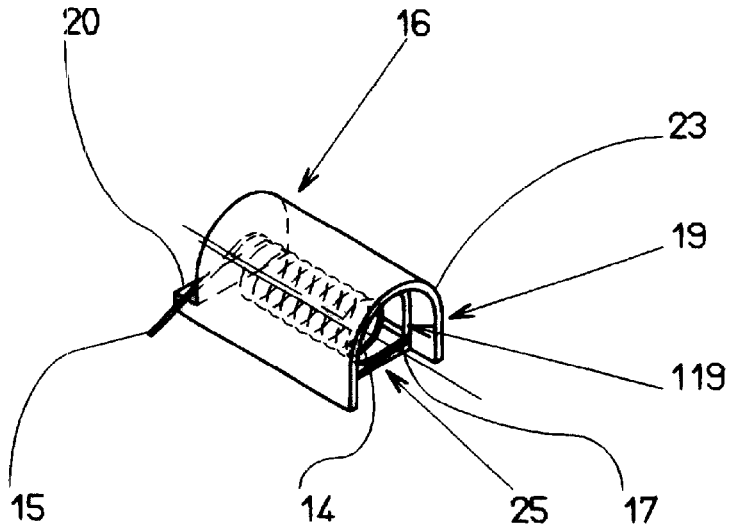
FIG. 4 is a perspective view of a casing housing a return spring of one embodiment of the present invention.
Figure 6:
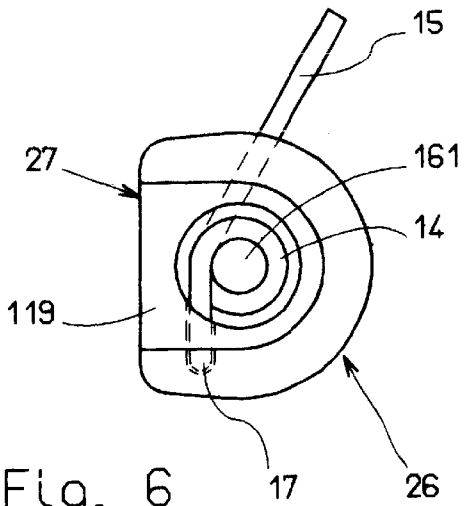
FIG. 6 is a view of a second end of the casing from FIG. 4.
Figure 8:
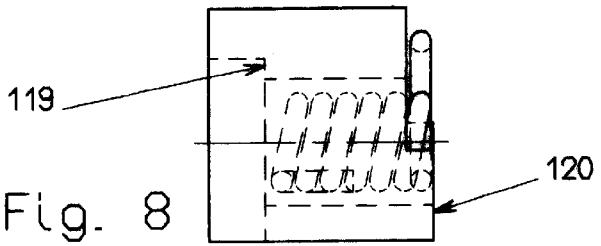
FIG. 8 is a top view of the casing from FIG. 4.
Figure 7:
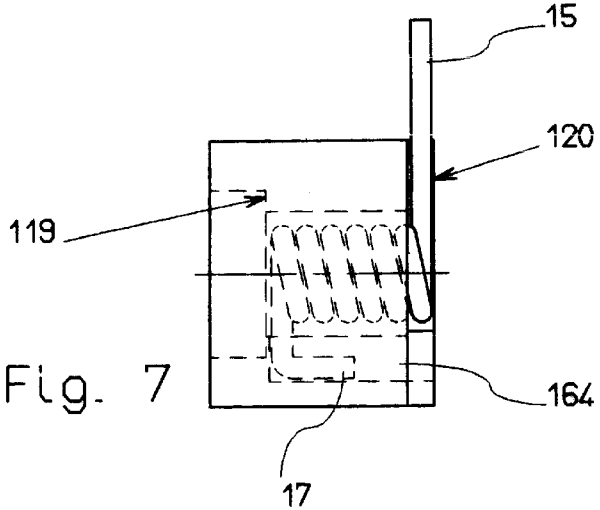
FIG. 7 is a front view of the casing from FIG. 4, with the spring inside it.
Figure 9:
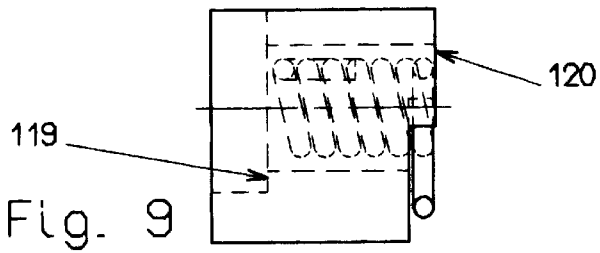
FIG. 9 is a bottom view of the casing from FIG. 4.
Figure 5:
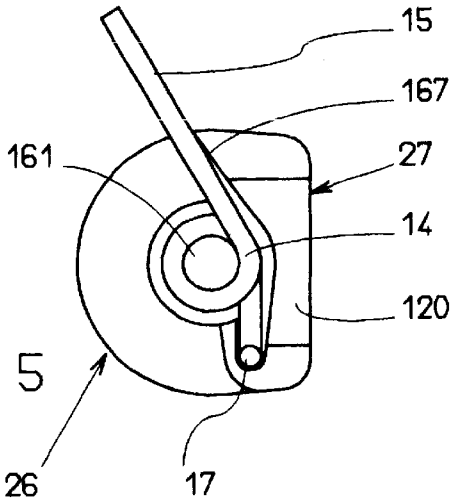
FIG. 5 is a view of a first end of the casing from FIG. 4.
Figure 10:
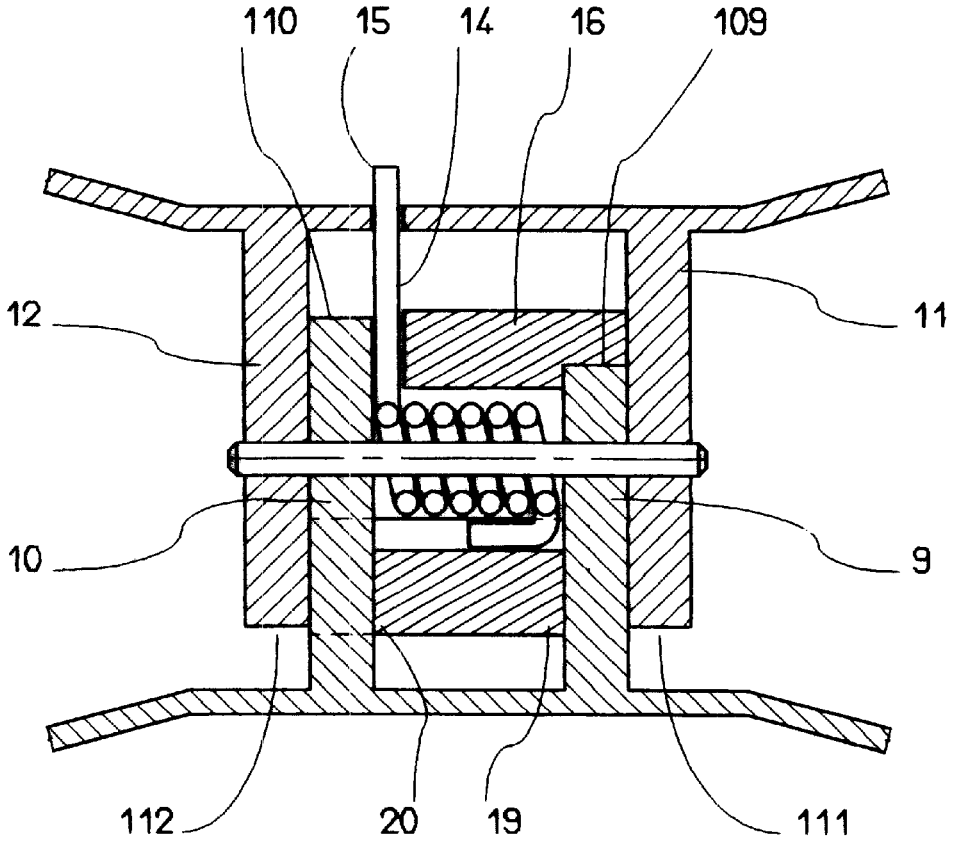
FIG. 10 is a front view in longitudinal section of the casing containing the spring and assembled onto the jaws of the hairstyling device.

Hinge means 7 connect the first intermediate connecting area 3 and the second intermediate connecting area 6, to enable the first jaw 1 and the second jaw 4 to pivot relative to each other about a transverse hinge axis 8 between a spread apart position shown in FIG. 3 and a close together position shown in FIG. 2. Spring means bias relative pivoting of the first jaw 1 and the second jaw 4 toward their close together position, in which their respective teeth 35, 36 cross over.

Figure 11:
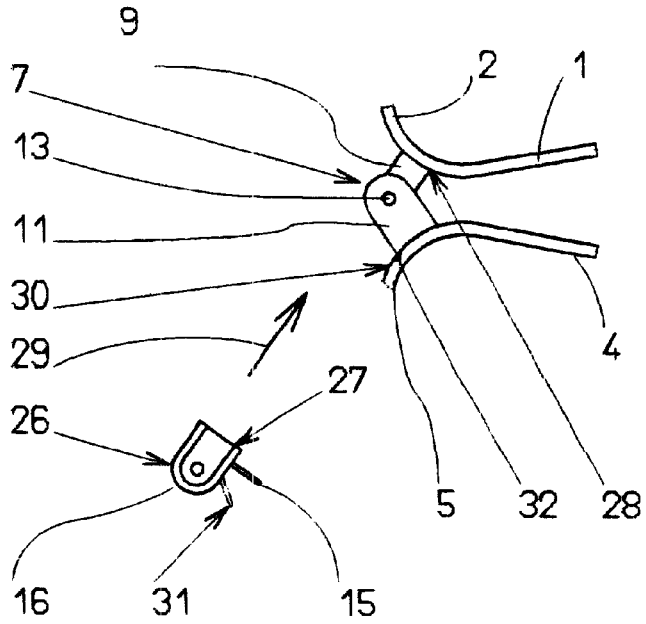
FIG. 11 is a partial side view showing the movement whereby a casing according to the invention is assembled onto the jaws of a hairstyling device.
Figure 12:
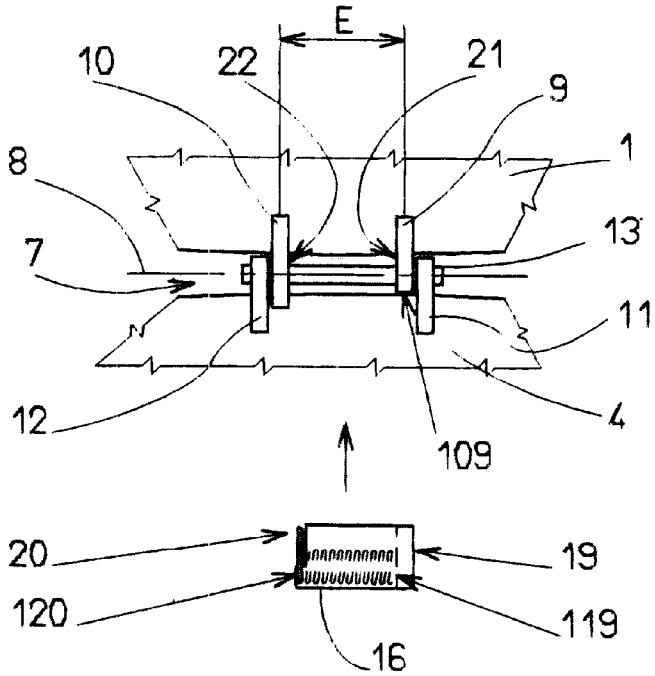
FIG. 12 is a partial front view showing the structure of the perforated lug hinge means and the assembly movement of the casing according to the invention toward the jaws.

The hinge means used in accordance with the invention can be seen more clearly in FIGS. 11 and 12, in which the spring means are not yet fitted to the jaws 1 and 4. These hinge means 7 include two parallel first perforated lugs 9 and 10 on the first jaw 1 spaced apart by a distance E for stability. The hinge means 7 further include two parallel second perforated lugs 11 and 12 on the second jaw 4 spaced apart by a distance appropriate for them to engage with respective opposite sides of the first perforated lugs 9 and 10. A connecting spindle 13, oriented along the transverse hinge axis 8, passes through the four perforated lugs to connect the jaws 1 and 4.

As can be seen in FIG. 1, the hinge means 7 further include an elastically flexible wire spring 14 wound in a helix around the transverse hinge axis 8 and having two radially projecting ends, for example the second end 15. The radially projecting ends of the spring 14 bias relative pivoting of the first jaw 1 and the second jaw 4 about the transverse hinge axis 8.

In accordance with the invention, the spring 14 is housed in a casing 16 fitting between the first perforated lugs 9 and 10 and fastened to the first jaw 1.

The casing 16 has a peripheral wall having a cylindrical external part 26 and a plane bearing face 27 shaped to bear against a corresponding plane face 28 of the first jaw when the casing 16 is assembled onto the first jaw 1. The first radially projecting end 17 of the spring 14 is fastened to the casing 16, and therefore fastened to the first jaw 1. The second radially projecting end 15 of the spring 14 exits the casing 16 in the radial direction and is engaged in a notch 18 at the end of the casing 16 to bear functionally against the second jaw 4, as shown in FIGS. 1 and 2.

The notch 18 at the end of the casing 16 allows angular movement of the second radially projecting end 15 of the spring 14 about the transverse hinge axis B.

The casing 16 has a first end 19 and a second end 20 each of which has a respective transverse face 119 or 120 shaped to bear against the corresponding facing inside faces 21 and 22 (FIG. 12) of the corresponding first perforated lugs 9 and 10. In the first end 19, the first transverse face 119 is associated with a rim 23 on three sides, surrounding at least in part the outside edge 109 of the first perforated lug 9. There is no rim on the bottom edge 25 of the first transverse face 119 at the first end 19. Accordingly, as can be seen in FIGS. 11 and 12, the casing 16 can be forcibly slid between the first perforated lugs 9 and 10 so that the transverse faces 119 and 120 of its ends 19 and 20 slide on the inside faces 21 and 22 of the first perforated lugs 9 and 10, while the rim 23 slides on the lateral edge of the first perforated lug 9. In the assembled position, shown in FIGS. 1 and 2, the casing 16 is therefore secured to the first jaw 1 in translation and in rotation, and is retained by the spring 14 around the connecting spindle 13.

The casing 16 has a tubular axial internal housing 161, open at both ends to provide a passage for the connecting spindle 13, and shaped to receive and retain the spring 14 and to prevent rotation of its first radially projecting end 17, which is housed in its bottom.

As can be seen more clearly in FIGS. 5 to 8, the casing 16 includes a longitudinal groove 164 allowing engagement of the first radially projecting end 17 of the spring 14. Accordingly, the spring 14 can be engaged in the axial internal housing 161 by sliding it axially from the second end. The second end of the casing 16 incorporates an oblique shoulder 167 extending from the bottom and on which the second radially projecting end 15 of the spring 14 bears. The shoulder 167 forms the first end of the end notch 18.

It may be useful to adapt, on the spring 14, a first radially projecting end 17 to be bent, with an axial portion, as shown in FIGS. 5 to 9. The force with which the spring bears on the casing is then distributed over a larger surface area, which reduces wear of the casing and the risk of play appearing.

According to the invention, there is no rim at the second end 20 of the casing 16, which includes an end notch 18 through which the second radially projecting end 15 of the spring 14 passes and in which the end 15 moves. The second end 20 simply bears against the other first perforated lug 10.

According to the invention, to achieve visual continuity of the hinge system between the lugs, the other first perforated lug 10 of the first jaw 1 is oversized so that its outside edge 110 is substantially continuous with the outside surface of the lateral wall of the casing 16.

In a first embodiment of the invention, only the other first perforated lug 10 of the first jaw 1 is oversized. As a result the second perforated lugs 11 and 12 are smaller than the casing 16, and remain set back.

In another embodiment, the second perforated lugs 11 and 12 carried by the second jaw 4 can also be oversized, so that their respective outside edges 111 and 112 are substantially continuous with the outside surface of the lateral wall of the casing 16.

In other words, the jaws 1 and 4 can be considered to include three perforated lugs 10, 11 and 12 of normal size, and one perforated lug 9 of reduced size so that it can be inserted into the end housing delimited by the rim 23.

The outside surface of the lateral wall of the casing 16 preferably takes the form of a sector of a circular cylinder concentric with the transverse hinge axis 8, as shown in the figures.

The ends 19 and 20 of the casing 16 have respective transverse faces 119 and 120 bearing against the facing inside faces 21 and 22 of the corresponding first perforated lugs 9 and 10.

The casing 16 is advantageously injection molded in one piece from a plastics material.

To fit the casing 16 to the first jaw 1, the casing 16 is moved in translation in the direction of the arrow 29 in FIG. 11 with the bearing face 27 at the front and with the jaws held with the holes in the perforated lugs 9–12 in alignment. In this orientation, the casing 16 slides between the first perforated lugs 9 and 10, and the second radially projecting end 15 of the spring 14 comes to bear on the inside face 30 of the second jaw 4. Accordingly, the second radially projecting end 15 of the spring is pushed back and pivots, as shown in FIG. 11 by the dashed lines 31. On completion of engagement of the casing 16 over the first perforated lugs 9 and 10, because the spring 14 is prestressed, the second radially projecting end 15 of the spring 14 can engage in a housing 32 formed on the inside face 30 of the second jaw 4.

The casing 16 is preferably made from an opaque material to conceal the spring 14 that it contains. In this way, as shown in FIG. 1, the hinge means 7 have a relatively continuous appearance which is much more esthetic than an exposed helical spring.

In the embodiments of the invention previously described, the casing 16 both conceals the spring 14 and facilitates assembly of the hairstyling device.

Because it is cheap to make and assemble, and because of the absence of excessively small components or parts of components, the device according to the invention can be used economically on all types of hairstyling devices, including cheap miniature hairstyling devices.

The present invention is not limited to the embodiments explicitly described, but includes variants and generalizations thereof contained within the scope of the following claims.

What is claimed is:

1. A hairstyling device including:

a first jaw and a second jaw, hinged together by hinge means enabling them to pivot about a transverse hinge axis between a spread apart position and a close together position, an elastically flexible wire spring wound helically around said transverse hinge axis and having two radially projecting ends respectively adapted to bias said first jaw and said second jaw relative to each other toward said spread apart or said close together position, said hinge means including two parallel first perforated lugs on said first jaw spaced apart by a distance for stability, and two parallel second perforated lugs on said second jaw spaced apart by a distance appropriate for them to engage with respective opposite sides of said first perforated lugs, with a connecting spindle oriented along said transverse hinge axis and passing through said four perforated lugs to connect said jaws, a casing attached between said first perforated lugs, retained in a fixed position on said first jaw and forming an axial internal housing containing at least said helically wound portion of said spring, said first radially projecting end of said spring being in fixed bearing engagement with said casing or with said first jaw, said second radially projecting end of said spring exiting said casing to bear functionally against said second jaw and to bias it toward said close together position, said casing having ends with axial openings through which said connecting spindle can pass, in which device:

said casing has a peripheral lateral wall with a generally cylindrical outside surface and its first end is extended by a rim on three of its sides to enclose at least in part the outside edge of the corresponding first perforated lug, said second end of said casing has no rim, and includes an end notch through which said second radially projecting end of said spring passes and in which it can move, and the other first perforated lug of said first jaw is oversized so that its outside edge is substantially continuous with the outside surface of the lateral wall of said casing.

2. The hairstyling device claimed in claim 1, wherein said casing is made in one piece.

3. The hairstyling device claimed in claim 1, wherein said second perforated lugs carried by said second jaw are oversized so that their respective outside edges are substantially continuous with said outside surface of said lateral wall of said casing.

4. The hairstyling device claimed in claim 1, wherein said outside surface of said lateral wall of said casing takes the form of a sector of a circular cylinder.

5. The hairstyling device claimed in claim 1, wherein said casing includes a tubular axial inside housing shaped to receive and retain said spring and to prevent rotation of its first radially projecting end, which is housed in its bottom, with a plane bearing face bearing against a corresponding plane face of said first jaw when said casing is assembled onto said first jaw.

6. The hairstyling device claimed in claim 1, wherein said ends of said casing each have a transverse face bearing against the facing inside faces of the corresponding first perforated lugs.

7. The hairstyling device claimed in claim 1, wherein said casing is injection molded from a plastics material.

* * * * *